US006083435A

United States Patent [19]

Albecker, III

[11] Patent Number: 6,083,435

[45] Date of Patent: Jul. 4, 2000

[54] METHOD FOR MAKING FIRM AREA INSIDE CUSHIONS

[76] Inventor: Walter J. Albecker, III, 838 S. May, Chicago, Ill. 60607

[21] Appl. No.: 08/821,706

[22] Filed: Mar. 19, 1997

Related U.S. Application Data

[63] Continuation-in-part of application No. 08/363,752, Dec. 23, 1994, abandoned, which is a continuation-in-part of application No. 07/899,750, Jun. 17, 1992, Pat. No. 5,425,567, which is a continuation-in-part of application No. 07/721,179, Jun. 26, 1991, abandoned.

[51] Int. Cl.[7] ..... B29C 44/06

[52] U.S. Cl. ..... 264/46.6; 264/45.1; 264/46.4; 264/259; 264/267

[58] Field of Search ..... 264/46.6, 48, 45.1, 264/267, 321, 259, 46.4

[56] References Cited

U.S. PATENT DOCUMENTS

| | | | |
|---|---|---|---|
| 3,257,149 | 6/1966 | Fruchte et al. | 264/45.1 |
| 3,320,339 | 5/1967 | Smith | 264/45.1 |
| 3,751,111 | 8/1973 | Taylor | 297/456 |
| 3,890,414 | 6/1975 | Ricciardi et al. | 264/45.1 |
| 4,190,697 | 2/1980 | Ahrens | 428/315 |
| 4,252,910 | 2/1981 | Schaefer | 521/145 |
| 4,916,765 | 4/1990 | Castronovo, Jr. | 5/437 |
| 5,192,482 | 3/1993 | Brambach | 264/261 |
| 5,252,270 | 10/1993 | Haardt et al. | 264/45.1 |

*Primary Examiner*—Allan R. Kuhns

[57] ABSTRACT

Disclosed is a method for providing various supports in cushions suitable for chairs sofas, and pillows. The method comprises piercing a previously manufactured cushion (86) with injecting needles (84) to inject a firming solution into the cushion (86) to provide the internal lumbar support (88). The needles (84) can be placed at a variety of different heights to product various effects. Also disclosed are a number of products that can be produced using the method, with explanations as to how the method can be adapted to produce each variation.

21 Claims, 15 Drawing Sheets

Figure 9A
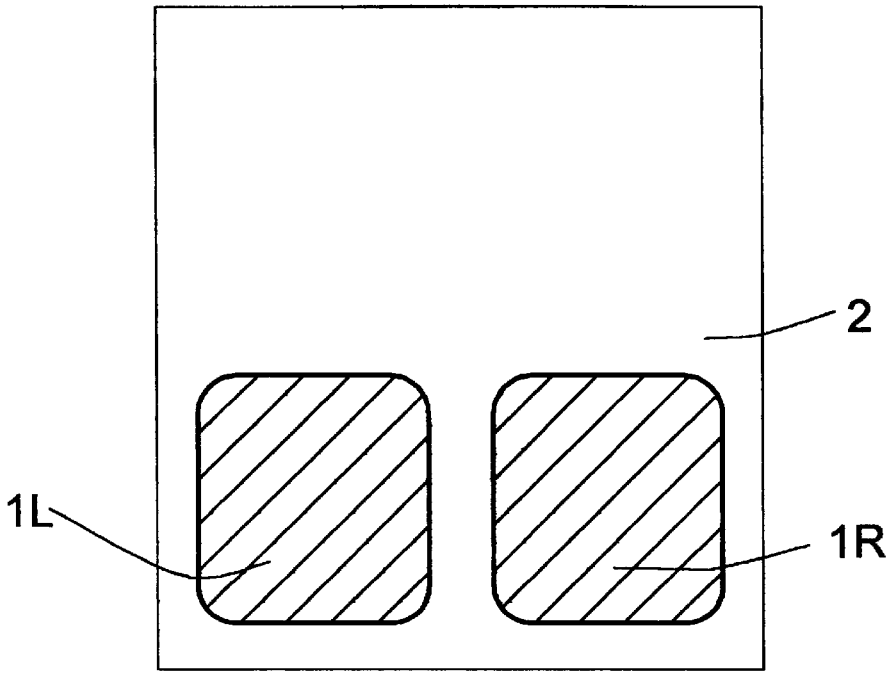
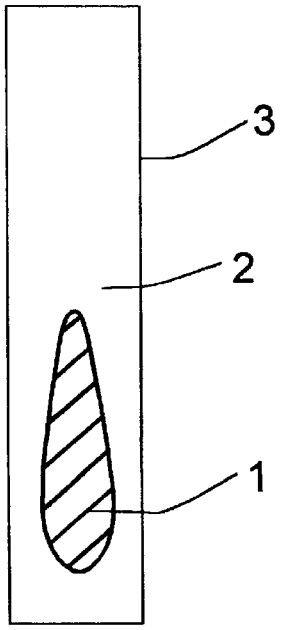
Figure 9B
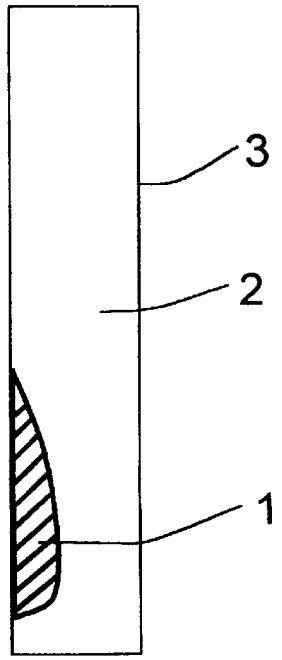
Figure 9C

Figure 10A
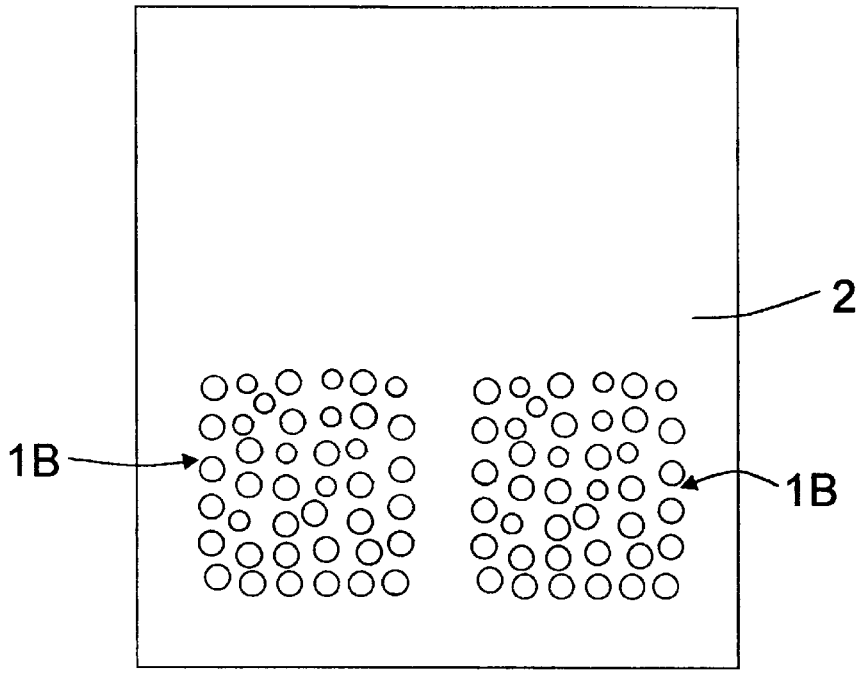
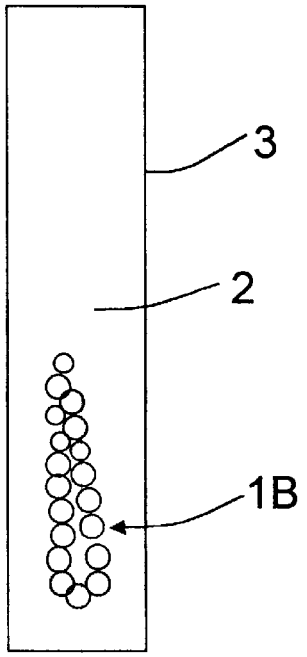
Figure 10B
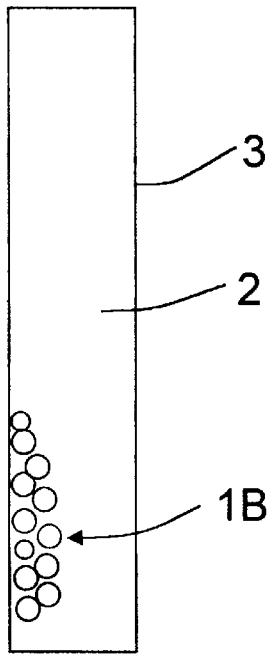
Figure 10C

Figure 15A
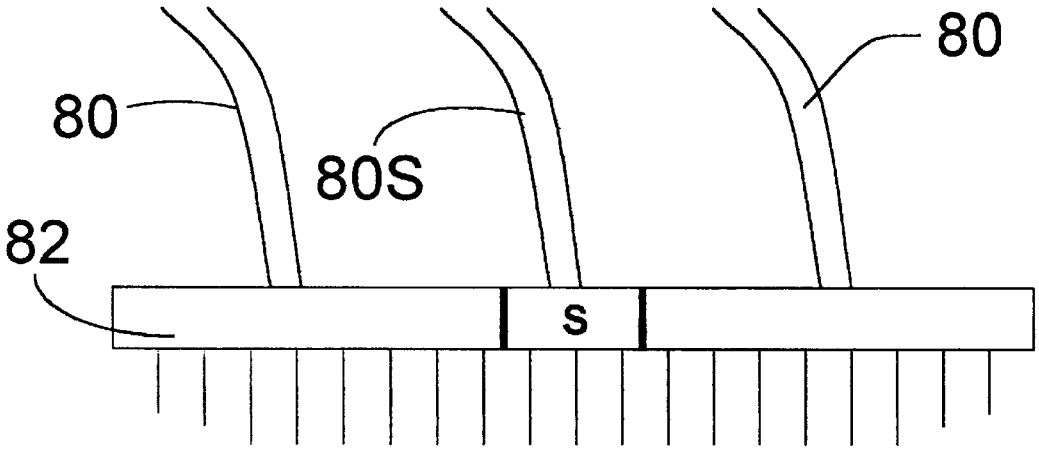
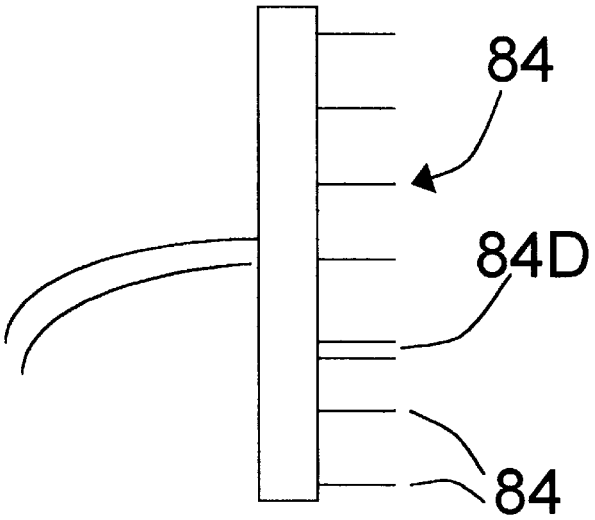
Figure 15B

METHOD FOR MAKING FIRM AREA INSIDE CUSHIONS

This is a continuation-in-part of application Ser. No. 08/363,752 filed Dec. 23, 1994, abandoned, which application is a continuation-in-part of application Ser. No. 07/899,750, field Jun. 17, 1992, now U.S. Pat. No. 5,425,567 which application is a continuation-in-part of application Ser. No. 07/721,179, filed Jun. 26, 1991, now abandoned.

BACKGROUND

1. Field of Invention

This invention relates to cushions for seats and/or backrests, and specifically to a method for making such cushions which are designated to support the user in a way which naturally balances the work of sitting to minimize stress, strain, and fatigue to key parts of the user's body.

2. Discussion of Prior Art

The pursuit of making chairs more comfortable has taken two basic forms. One approach is to contour the body contacting surfaces of the chair to provide good support to critical parts of the user's body such as the lumbar region of the back. Though contouring is generally an effective solution, it can have the drawback of being relatively expensive to manufacture, and it may not be aesthetically appropriate for some styles of furniture, or people's tastes.

The second approach deals with the inherent support of the cushion materials and internal support inserts. A number of methods have been employed to make such cushions. Some methods involve positioning an insert such as springs or a frame in a mold, and then injecting polyurethane or another cushion material into the mold so that the finished product will be a cushion with an internal support such as a spring. In my previous invention, I described a method of making a hollow in a cushion with a cutting tool, and then filling the hollow with a firmer foam insert.

OBJECTS AND ADVANTAGES

Accordingly, several objects and advantages of my present invention are:

(a) To provide a very simple and economical way to make cushions, in many common shapes and sizes, with an internal support member, that will work in conjunction with the primary cushion material to support the user's body.

(b) To provide a method for making cushions ergonomically supportive that involves no wasted materials.

(c) To provide a method of making cushions with an internal lumbar support that eliminates the need for gluing the insert to the main cushion.

(d) To provide a method of making internal supports in cushions that can be of irregular shapes to provide optimal support to the user.

(e) To provide a method for making cushions for chairs and the like with good support, that can be made reversible if desired.

(f) To provide a clearly defined lumbar support in backrest cushions.

(g) To provide balanced support to the thighs and buttocks in seat cushions.

Still further objects and advantages will become apparent from a consideration of the ensuring description and drawings.

BRIEF DESCRIPTION OF THE DRAWINGS

FIG. 9A is a front view of a cushion produced using the present INVENTION having two firm support areas.

FIG. 9B is a side view of the cushion shown in FIG. 9A which could be used as a reversible cushion with the firm area in between the face and the back.

FIG. 9C is a side view of the cushion shown in FIG. 9A made for use as a fixed cushion with the firm area away from the face but extending to the back.

FIG. 10A is a front view of a cushion produced using the present INVENTION having a number of firm balls working together to form support areas.

FIG. 10B is a side view of the cushion shown in FIG. 10A which could be used as a reversible cushion with the support areas in between the face and the back.

FIG. 10C is a side view of the cushion shown in FIG. 10A made for use as a fixed cushion with the support areas away from the face but extending near the back.

FIG. 15A is a front view of an injector support base and injecting needles that could be used to produce the insert shown on the cushion in FIG. 7B.

FIG. 15B is a side view of an injector support base and injecting needles that could produce a firm insert in a cushion similar to the one shown in FIGS. 7A–C using a large diameter needle where the cushion will extend the furthest.

DESCRIPTION OF INVENTION

Operation of Invention—Method of Cushion Manufacture

Figure 1A:
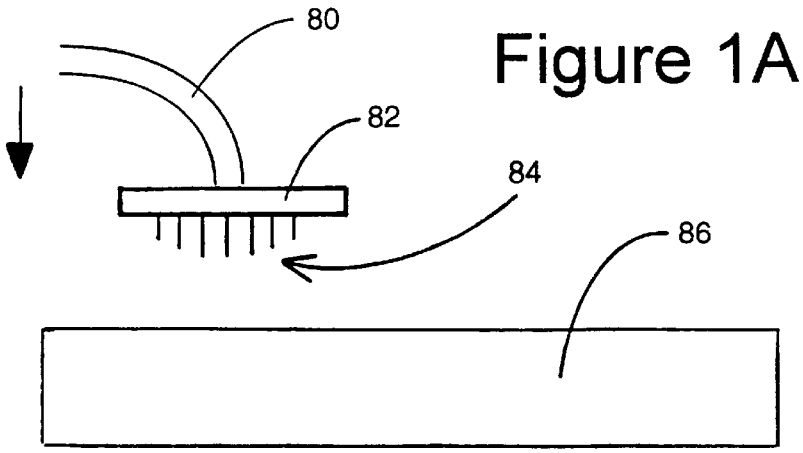
FIG. 1A is a side view of a cushion that is about to be pierced with injecting needles on a support base to produce a firm internal support member.
Figure 1B:
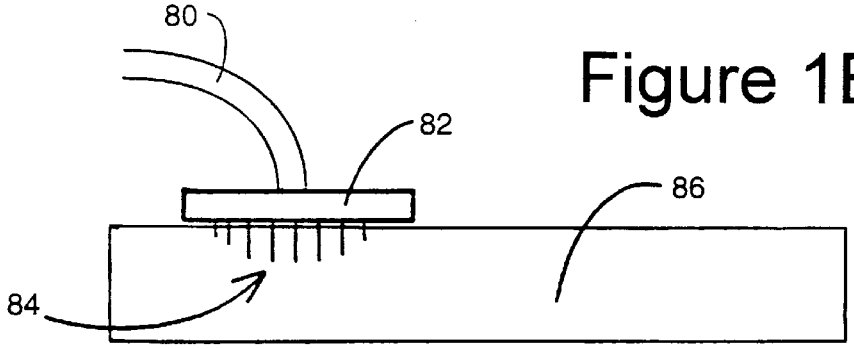
FIG. 1B is a side view of the cushion shown in FIG. 1A after being pierced with the injecting needles.
Figure 1C:
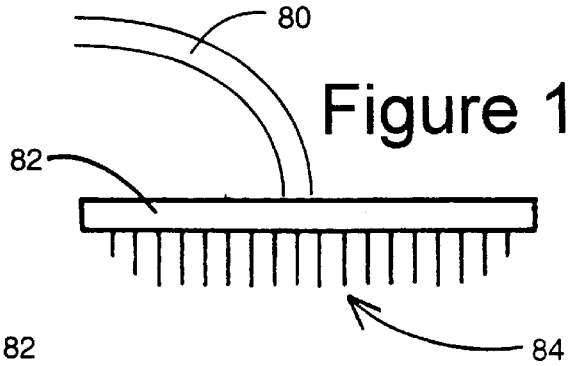
FIG. 1C is a front view of the injector support base and injecting needles shown in FIGS. 1A, 1B, and 1D.
Figure 1D:
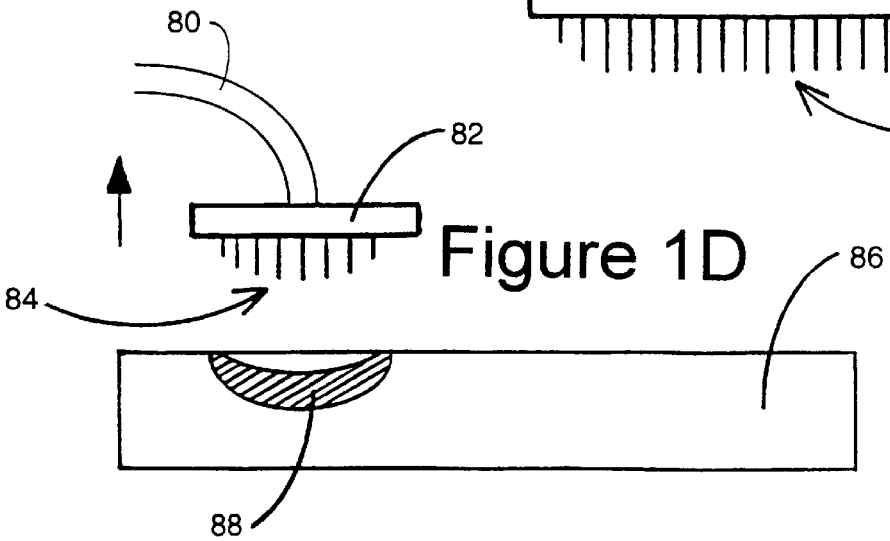
FIG. 1D is a cross section view of the cushion shown in FIGS. 1A and 1B, after the injecting needles shown in FIGS. 1A, 1B, and 1C have injected a foaming compound into the cushion. This drawing shows the firm internal support member that has been produced in the cushion, after the injecting needles have been withdrawn.

FIG. 1A is a side view of a cushion 86 that is about to be pierced with injecting needles 84 on a support base 82 to produce a firm internal support member similar to the lumbar support shown in FIG. 1D. In this drawing, there is a hose or hoses 80 which carry a firming means into the injector support base 82. The firming means is a chemical solution that will make a previously manufactured foam cushion firmer wherever the chemical solution contacts the foam cushion. In a preferred embodiment, the firming means are foaming chemicals as described below. From the injector support base 82, the chemicals are distributed to, and forced through the series of injecting needles 84. The injecting needles 84 work on the same principles as hypodermic needles, but need to have an inside diameter of about ⅛" since the viscosity of the foaming chemicals will not go through a much smaller opening efficiently. The cushion 86 is a typical previously manufactured flexible foam cushion made of polyurethane foam or the like. It would be made of a relatively soft grade of foam with an ILD (Indentation Load Deflection on 4" at 25%) between about 10 pounds and about 35 pounds.

FIG. 1B is a side view of the cushion 86 shown in FIG. 1A after being pierced with the injecting needles 84. The cushion 86 is shown clear to show the injecting needles 84 in position. Note that the needles 84 are of different lengths, and the needles are positioned in such a way that the shape they form together is generally semi-elliptical. It should also be pointed out, that the injecting needles do not need to go as deep as of the depth of the desired firm internal support member. The reason for this is that when the foaming chemicals are injected into the cushion, the cushion 86 will soak them up to a fair extent. So the needles only need to pierce to about 1" from the desired finished depth, and the foaming chemicals will soak to the desired point. Since the cushion 86 is positioned face down, it appears that the soaking is caused by injection pressure, foaming pressure, capillary action, and gravity, but I do not with to be bound by this belief. Because of the soaking action, it is only necessary to have about one injecting needle for about each square inch of firm internal support member to be produced.

The firming means can be the kind of chemicals used for foam-in-place seating such as is used for custom wheelchairs. The produce names for a solution that works for this procedure are Isonate (R) 143L Modified MDI, Dabco 33-LV Catalyst, and FIPS POLYOL, all made or distributed by Dynamic Systems, Inc., Rt. 2, Box 182B, Leicester, N.C. 28748. The formulation of the above chemicals when combined was listed by the manufacturer as "SOFT". Though this chemical solution will work, it is anticipated that other chemical solutions, both foaming and non-foaming will also work to provide a firm internal support member. Depending on the chemicals used, the mixing of the chemicals can take place in the chemical hoses 80, before being put in the chemical hoses 80 or in the injector support base 82. Because of the speed with which the chemicals mentioned above begin foaming, in a preferred embodiment of this invention, each chemical is pumped through a separate hose, and there is a mixing means in the injector support base 82 or just inches away from the injector support base 82. Also in a preferred embodiment there are valves for each chemical coming into the support base 82 to prevent contamination of the fresh chemicals, and to control the process. The injector support base 82 shown is merely representative, and would of course be larger and more complex with valves and a mixing element. The means for mixing the chemicals can be similar to the mixing type valves currently used for ordinary type flexible foam injection molding. It is necessary to have enough pressure on the foam solution being injected, so that it can be forced through the injecting needles 84 and into the existing foam cushion 86.

The injecting needles could have different inside diameters to control the volume of the foaming chemicals to specific areas. It is further possible to have a number of holes in the walls of the injecting needles in addition to, or in place of the hole at the tip of the injection needles as was inferred above by the comparison to a hypodermic needle.

In a production setting, the preferred embodiment is envisioned on a motorized machine working like a drill press. The previously manufactured cushion 86 would be put into position, and the injector support base 82 with injecting needles 84 would be lowered to that they pierce the cushion 86 to the desired depth. Then a predetermined amount of foaming chemical would be injected into the cushion 86 through the injecting needles 84. After this, the injecting needles 84 would be withdrawn, and the foaming chemicals would soak into the cushion 86 and cure to the predetermined firmness. This procedure would be repeated for another cushion right after the first one.

FIG. 1C is a front view of the injector support base 82 and injecting needles 84 shown in FIGS. 1A, 1B, and 1D. Comparing this view with one of the side views of the injector support base 82 and injecting needles 84 as in FIG. 1A, one can see how the 8 rows of 18 injecting needles are arranged. Such an arrangement would be suitable for making a lumbar support similar in size and shape to the one shown in FIG. 1D. The injecting needles 84 do not necessarily have to be in neat lines as shown, but could also be staggered, or put in another pattern. Also, on other embodiments, the number and sizes of the injecting needles could be altered to suit the need. It should also be possible to adapt this method to make different shapes of internal support members, including generally cylindrical support members.

FIG. 1D is a cross section view of the cushion 86 shown in FIGS. 1A and 1B, after the injecting needles 84 shown in FIGS. 1A, 1B, and 1C have injected a foaming compound into the cushion 86. This drawing shows the firm internal support member 88 that has been produced in the cushion 86, after the injecting needles 84 have been withdrawn. The internal support member is shaped like a generally semi-elliptical cylinder. As shown, the cushion body 86 is about 5" thick, and the internal lumbar support is about 2" to 3" thick. There can be many variations in both cushion thickness as well as lumbar support thickness as well as variations in the firmnesses of each. These have been described in U.S. Pat. No. 5,474,362. For the invention to work as described in the above mentioned patent, it is necessary to have the internal support member at least ½" thinner than the main cushion to provide a relatively soft body contacting surface on the face of the cushion. Note that there is a soft spot or piece of regular cushion material right above the firm internal support member 88. This is because the foaming chemicals did not soak into this area. Though this small area is softer than the portion where the foaming chemicals soaked into, it should not affect the effectiveness of the firm internal support member.

Figure 2:
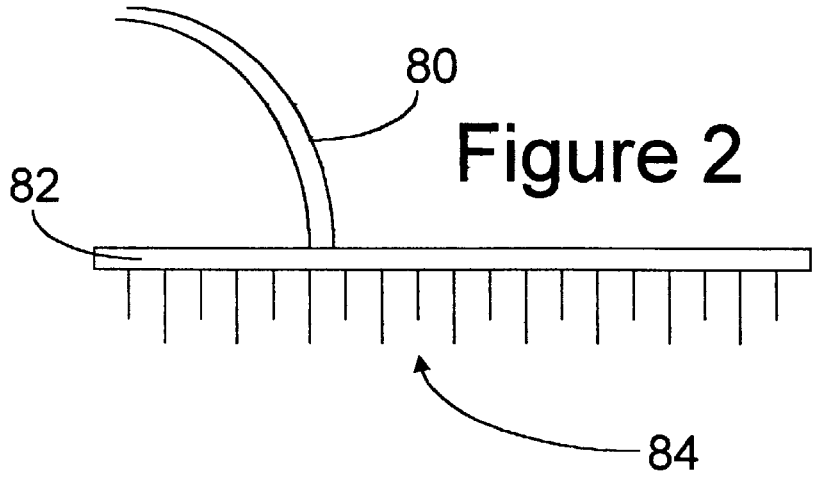
FIG. 2 is a front view of the injector base support and injecting needles shown in FIG. 1C, but with the needles at different heights to form an eggcrate pattern on the lumbar insert.

FIG. 2 is a front view of the injector base support and injecting needles shown in FIG. 1C, but with the needles at different heights to form an eggcrate pattern on the lumbar insert.

Figure 3:
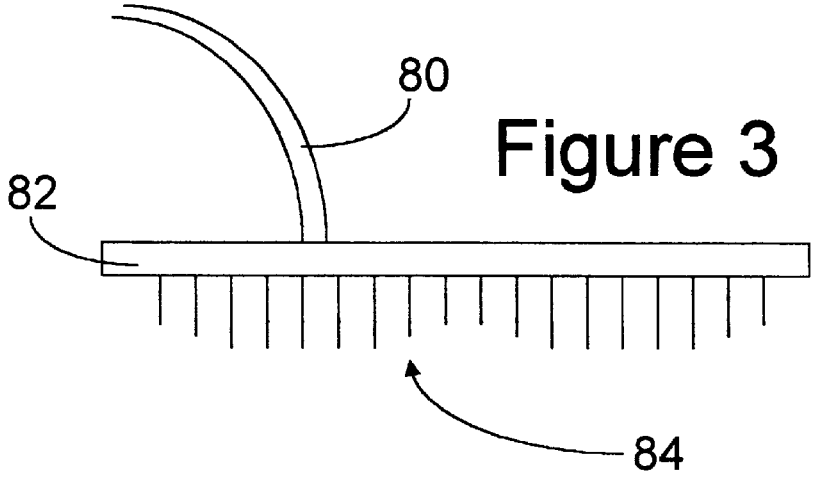
FIG. 3 is a front view of the injector base support shown in FIG. 1C, but with the needles at different heights to not put pressure on the spine of the user of the cushion.

FIG. 3 is a front view of the injector base support shown in FIG. 1C, but with the needles at different heights to not put pressure on the spine of the user of the cushion.

Figure 4:
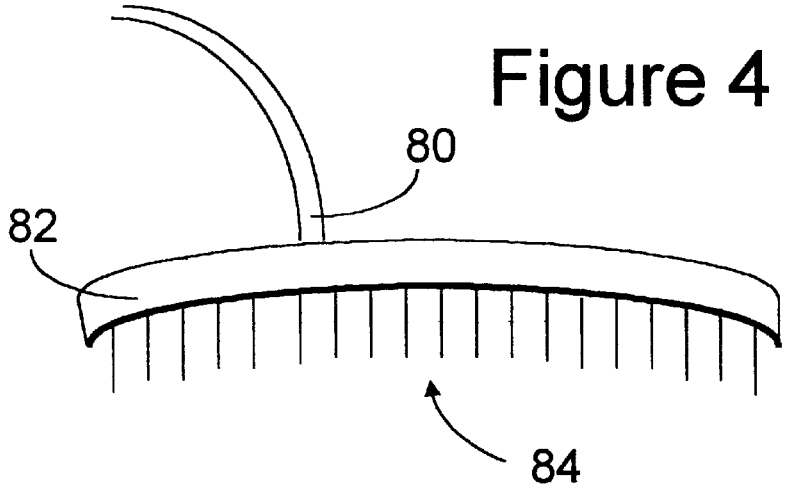
FIG. 4 is a front view of the injector base support shown in FIG. 1C but with the support curved to cradle the back of the user of the cushion.

FIG. 4 is a front view of the injector base support shown in FIG. 1C but with the support curved to cradle the back of the user of the cushion.

Figure 5:
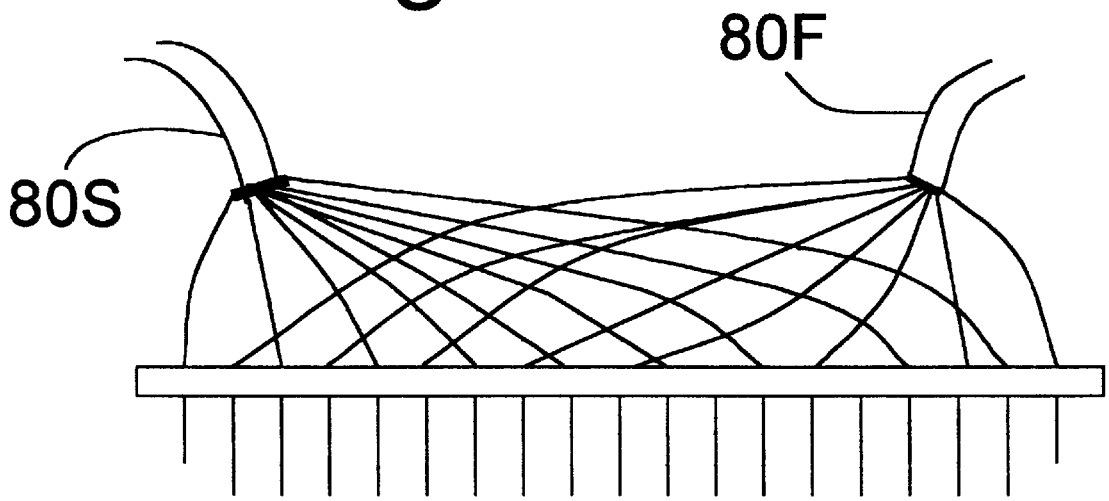
FIG. 5 is a front view of the injector support base and injecting needles shown in FIG. 1C, but shown with different hoses to put different firming solutions into the cushion.

FIG. 5 is a front view of the injector support base and injecting needles shown in FIG. 1C, but shown with different hoses to put different firming solutions into the cushion.

Figure 6:
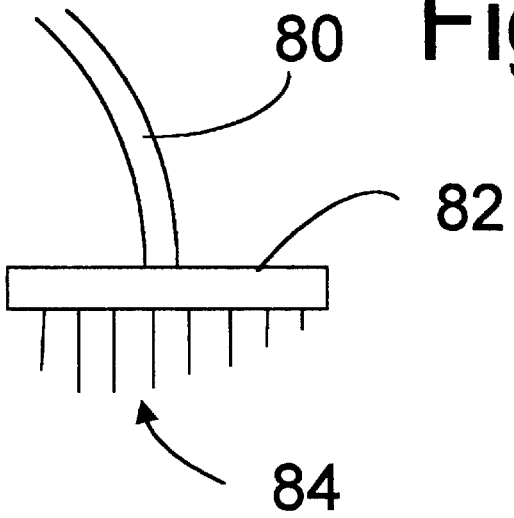
FIG. 6 is a side view of the injector support base shown in FIG. 1A, but with the needles arranged to give a different shape.

FIG. 6 is a side view of the injector support base shown in FIG. 1A, but with the needles arranged to give a different shape.

Figure 7A:
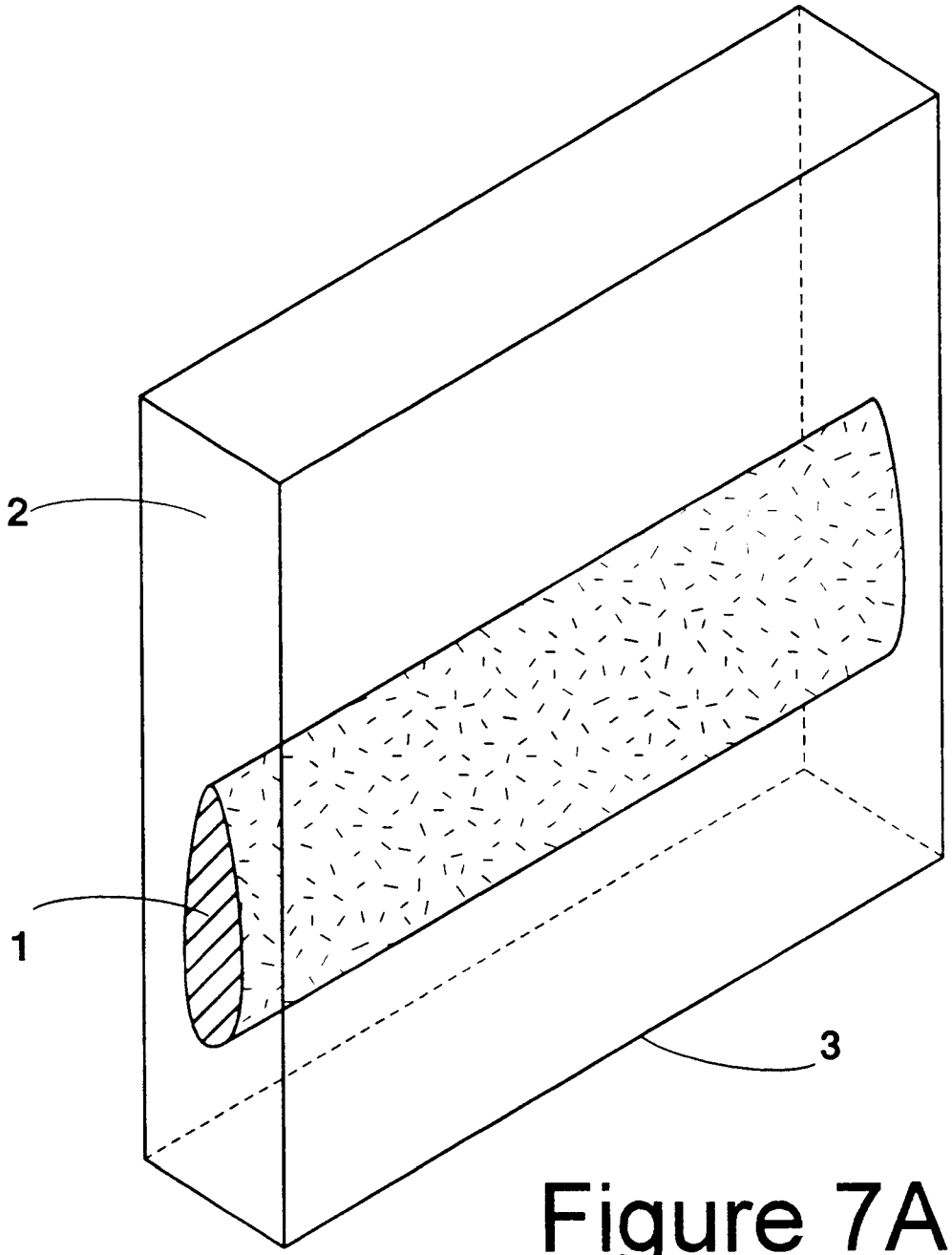
FIG. 7A is a perspective view of a typical embodiment of a cushion made using the present INVENTION.

FIG. 7A shows a perspective view of a reversible backrest cushion of the type that could be produced employing the present INVENTION. In the drawing, a rectangular cushion body 2 is shown with an internal lumbar support member 1. The cushion material of 2 is made of a relatively soft, or low to medium firmness flexible polyurethane foam, and has an oval shaped cylindrical core removed. Each perspective view shows the cushions having a top, a bottom, a face (the body contacting surface 3), a back (the side opposite the body contacting surface), and two sides. These should be obvious when looking at FIGS. 7A, 7B, 7C, 9A, 9B, 9C, 10A, 10B and 10C. Likewise, each firm foam lumbar support has a top, a bottom, a front (the side facing the body contacting surface of the cushion body), a back, and two sides. Also, each would have a transverse center line, and substantially all (at least 70%) of the firm foam insert and corresponding channel shaped void would fall below the transverse center line. The face or body contacting surface of the cushion 3 is what the person seated in a chair or the like using the cushion, would put his or her back against. The firm foam support member are shaped, sized and positioned to provide good support to the lumbar region of the user's body. Details on size, shape, and position of the cavity and support member are included under Operation of the INVENTION and Further Details of U.S. Pat. No. 5,474,362.

Figure 7B:
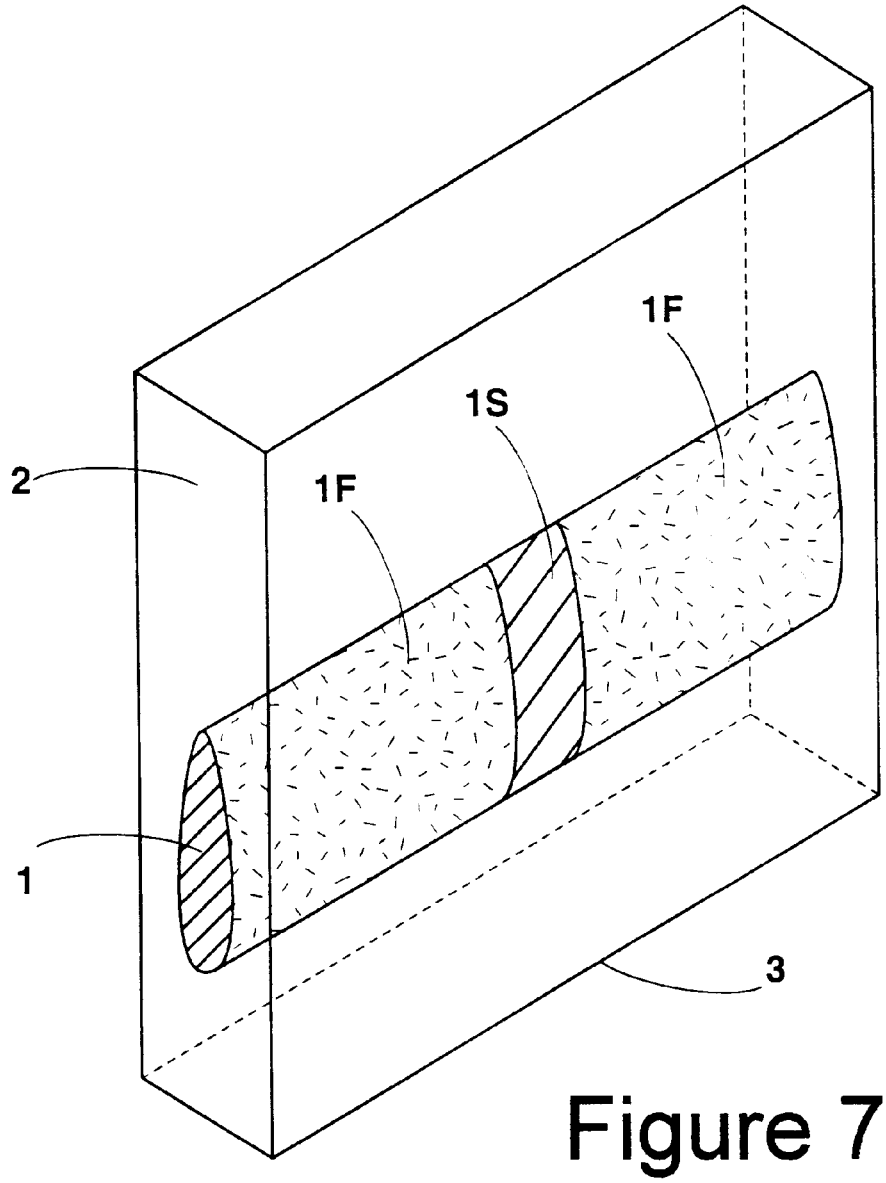
FIG. 7B is a perspective view of an embodiment similar to the one shown in FIG. 7A, but with a softer foam material in the center portion of the firm foam lumbar support.

FIG. 7B shows a perspective view of a reversible backrest cushion similar to the cushion shown in FIG. 7A, but with the internal lumbar support member 1A made with a relatively soft foam material in the center portion 1S. The relatively soft foam material in the center portion 1S surrounded by the firmer foam material on each side 1F is there to better distribute the weight of the user's back so that the spinal column will not be supporting the bulk of the weight near the lumbar region of the back. This enables the weight to be spread over a greater portion of the lumbar region of the back. This soft center portion 1S can be more comfortable on the spinal column. In a preferred embodiment, this center portion 1S is between about 2" and about 4–, and is positioned to line up with the expected position of the spinal column of the occupant when sitting against the cushion. Reference to center portion is made with respect to the sides of the internal support member. The firmness of the center portion 1S would be softer than the firmness of the outer portions 1F, and could even be softer than the main cushion body 2. In a preferred embodiment, the outer portions 1F has an ILD of between about 40 and 60 pounds, and the center portion 1S has an ILD of about 30 pounds.

Figure 7C:
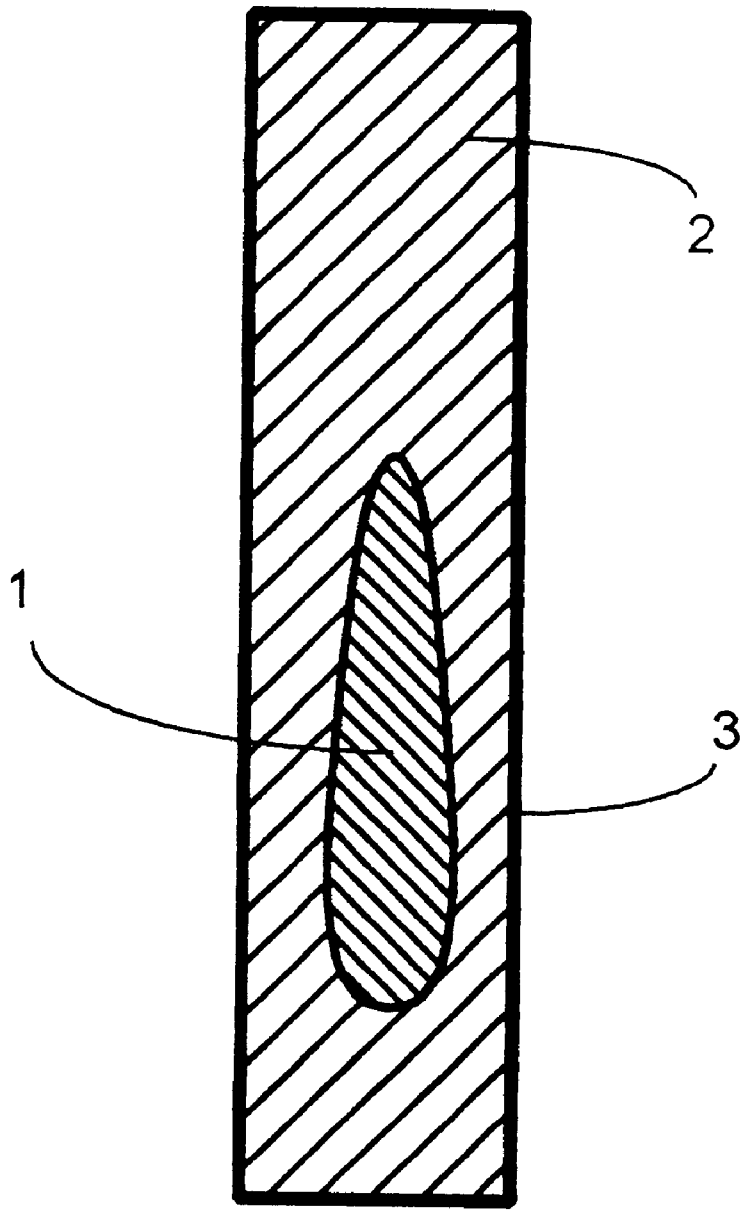
FIG. 7C is a cross section view of a reversible backrest cushion similar to the ones shown in FIGS. 7A and 7B.

FIG. 7C shows a side or cross section view of the same cushion as FIG. 7A. Again, 1 is the firmer foam lumbar support member, 2 is the low to medium firmness cushion body, and 3 is the face or body contacting surface of the cushion. This cushion is for use on chairs and the like that are designed with removable and reversible cushions, but can also be used with chairs and the like with fixed in place cushions. Though 3 is shown as the body contacting surface, it should be noted that if this were a reversible cushion, it would have two body contacting surfaces which are opposite one another. So 3 is a body contacting surface, and the side opposite 3 could also be a surface that contacts the user's body. This provides the opportunity to make a reversible cushion that can offer two different degrees of lumbar support. This could be achieved either by injecting the lumbar support 1 closer to the body contacting surface 3 or by making the lumbar support 1 extend further on one side instead of being symmetrical. The lumbar support 1 could be made more pronounced on the side of the body contacting surface 3, and less pronounced on the opposite side. One way of doing this would be to have the lumbar support member by a cylinder that is generally oval on the side toward 3, and generally elliptical on the side opposite 3. The result would be greater lumbar support when 3 is used as the body contacting surface, and less lumbar support when the side opposite 3 is used as the body contacting surface.

Figure 8:
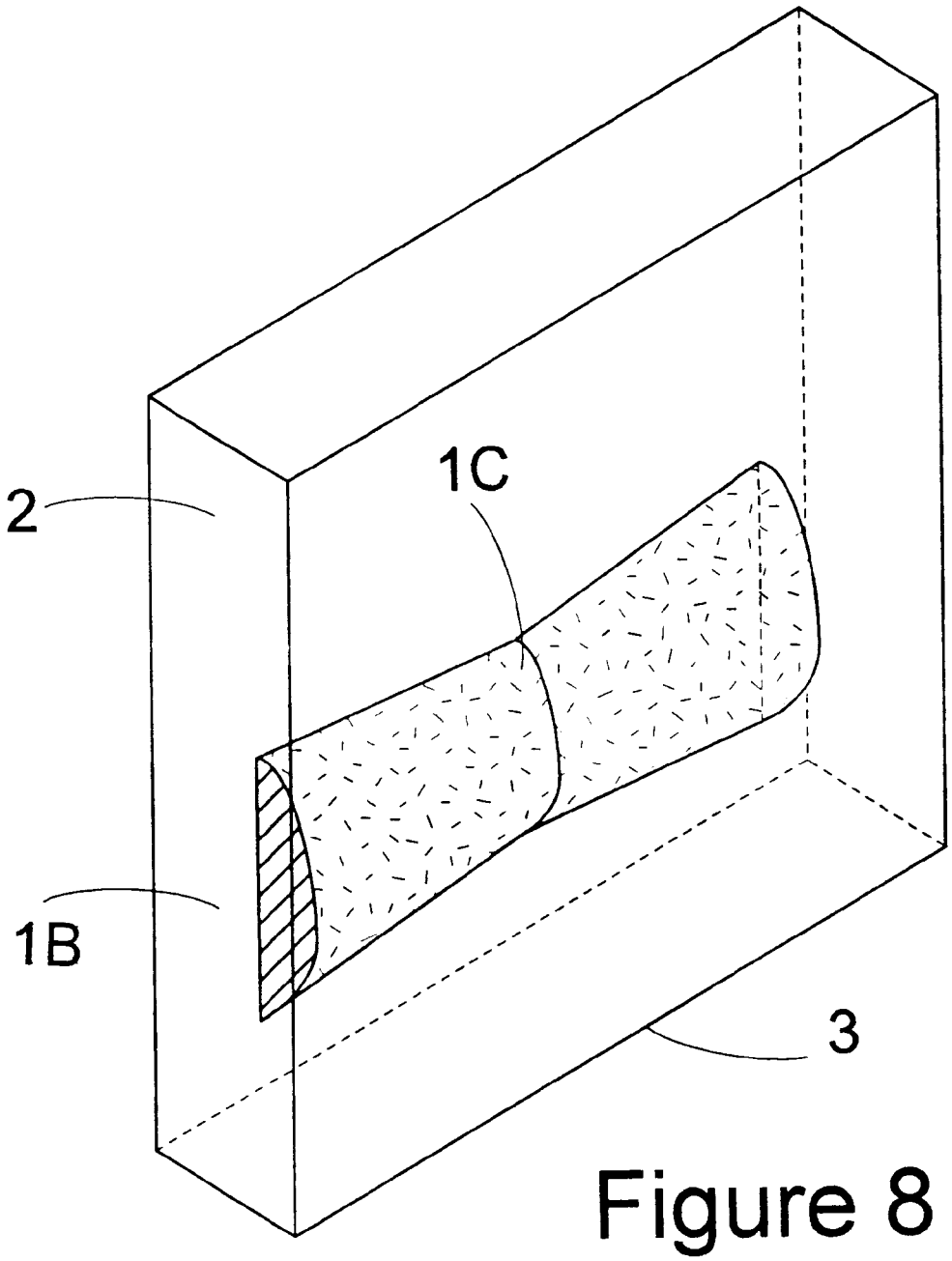
FIG. 8 is a perspective view of an embodiment that would be made using the method of the present invention made with injecting needles arranged like shown in FIG. 3.

FIG. 8 is a perspective view of an embodiment that would be made using the method of the present INVENTION made with injecting needles arranged like shown in FIG. 3. As shown, the lumbar support 1B is somewhat depressed in the center 1C. The advantage of making a firm lumbar support generally as shown is that the spine is not made to bear much pressure, making it more comfortable for some people. The lumbar support 1B does not extend to the face 3 of the cushion body 2. This type of cushion as shown would probably not be reversible, but it would be possible to make it reversible by making the lumbar support generally symmetrical and keeping it away from both the face 3 and the back.

FIG. 9A is a front view of a cushion body 2 shown clear produced using the present INVENTION having two firm support areas. The cushion Body is shown clear to enable a view of the lumbar supports 1R and 1L. In many ways this is similar to the cushion in 7B, but instead of injecting a softer firming solution into the cushion at the center of the lumbar support, the center of the cushion 2 in FIG. 9A is left without letting the firming solution soak into this area. The cushion body 2 and face 3 are similar to the ones described for other cushions. The lumbar support is made up of a right portion 1R and a left portion 1L.

FIG. 9B is a side view of the cushion shown in FIG. 9A which could be used as a reversible cushion with the firm area in between the face and the back. As seen in the drawing, the lumbar support 1 is at least ½" away from both the face 3 and the back.

FIG. 9C is a side view of the cushion shown in FIG. 9A made for use as a fixed cushion with the firm area away from the face but extending to the back.

FIG. 10A is a front view of a cushion produced using the present INVENTION having a number for firm balls 1B working together to form support areas. Again, in this drawing the cushion body 2 is shown clear to show the lumbar support balls 1B. In this embodiment, the balls are not touching each other, but the could be. Also, the balls 1B are shown spaced somewhat alternately to provide for the space between the balls.

FIG. 10B is a side view of the cushion shown in FIG. 10A which could be used as a reversible cushion with the support areas 1B in between the face 3 and the back.

FIG. 10C is a side view of the cushion shown in FIG. 10A made for use as a fixed cushion with the support areas away from the face but extending near the back.

Figure 11:
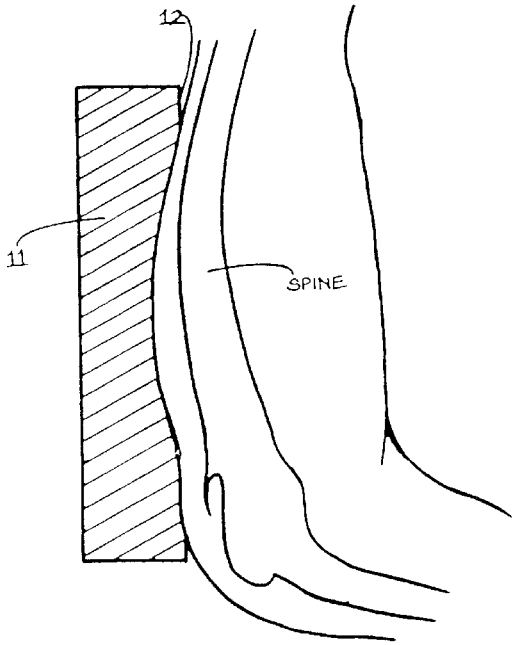
FIG. 11 is an illustration showing how a typical backrest cushion not embodying the firm support area produced by the present INVENTION fails to provide good support, and as a result, the user's back is in an unnatural alignment.

FIG. 11 is an illustration showing how a typical backrest cushion not embodying the product produced by the present INVENTION, fails to properly support the user's back. In the drawing, 11 is a basic cushion of the prior art, 12 is the face or body contacting surface of the cushion, and next to the cushions is a view of what happens to a user's spine and body when a backrest fails to provide good lumbar support. Without the proper lumbar support, the spine is unnaturally curved, which placed more stress on the back, causing fatigue and discomfort.

Figure 12:
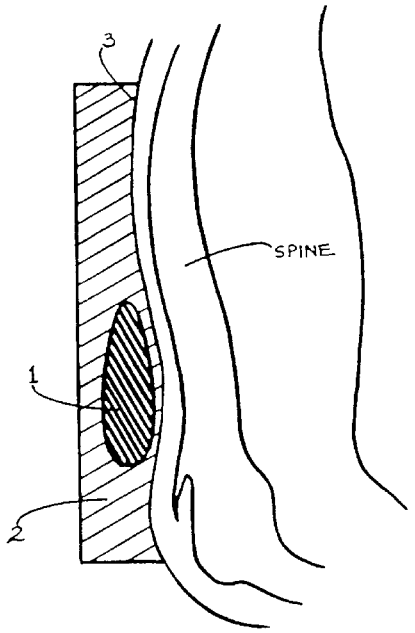
FIG. 12 is an illustration showing how a typical backrest embodying a firm lumbar support a would be made using the present INVENTION does provide good support, and as a result, the user's back is in a comfortable and more natural position.

FIG. 12 is an illustration showing how the backrest cushion, shown in FIGS. 7A, 7B, or 7C produced using the present INVENTION, does properly support the user's back. In the drawing, 1 is a high firmness flexible polyurethane foam oval cylinder lumbar support member, 2 is a low to medium firmness flexible polyurethane foam cushion body, 3 is the face or body contacting surface of the cushion, and next to the cushion is a view of what happens to a person's spine and body when they are properly supported with a cushion embodying the present INVENTION. FIG. 12 illustrates how the natural curve of the back is maintained through use of the lumbar support. Maintaining this position reduced stress, strain, and fatigue on the spine and back muscles, making the user more comfortable for extended periods of time.

Figure 13A:
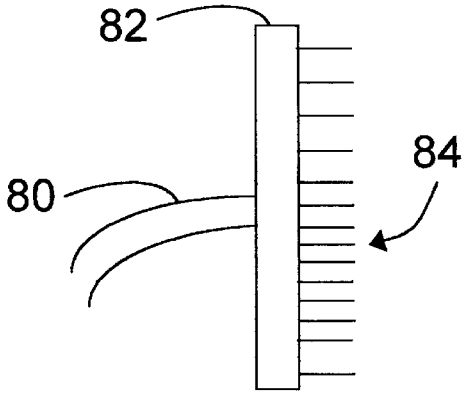
FIG. 13A is a side view of an injector support base and injecting needles that could produce a firm insert in a cushion similar to the one shown in FIGS. 9A and 9B.

FIG. 13A is a side view of an injector support base 82 and injecting needles 84 that could produce a firm insert in a cushion similar to the one shown in FIGS. 9A and 9B. Note that at the point where the lumbar support would extend the furthest, there are additional injecting needles 84.

Figure 13B:
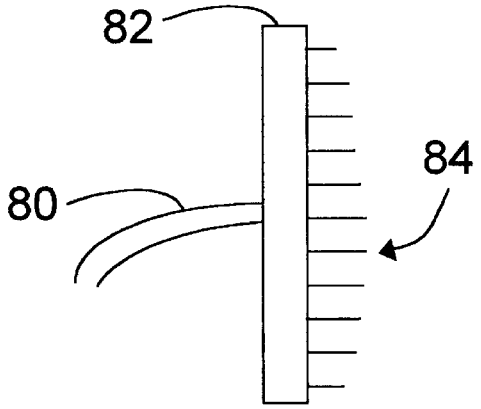
FIG. 13B is a side view of an injector support base and injecting needles that could produce a firm insert in a cushion similar to the one shown in FIGS. 9A and 9C.

FIG. 13B is a side view of an injector support base 82 and injecting needles 84 that could produce a firm insert in a cushion similar to the one shown in FIGS. 9A and 9C.

Figure 13C:
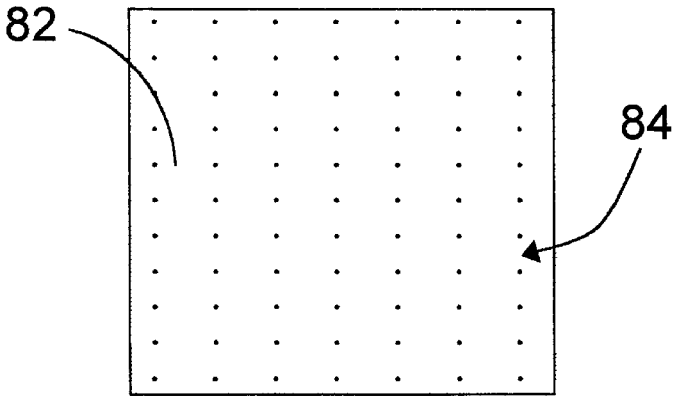
FIG. 13C is an underside view of an injector support base and injecting needles that are shown in FIGS. 13A and 13B.

FIG. 13C is an underside view of an injector support base 82 and injecting needles 84 that are shown in FIGS. 13A and 13B.

Figure 14A:
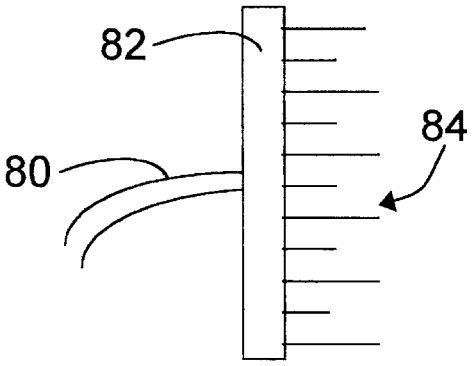
FIG. 14A is a side view of an injector support base and injecting needles that could produce a number of firm balls in a cushion similar to the one shown in FIGS. 10A and 10B.

FIG. 14A is a side view of an injector support base 82 and injecting needles 84 that could produce a number of firm balls in a cushion similar to the one shown in FIGS. 10A and 10B. The size as well as number of balls and spacing can be controlled by varying the spacing, size, pressure used on the firming solution, viscosity of firming solution ,and number of needles. The length of the needles 84 is staggered to space the balls between the face and back of the cushion body.

Figure 14B:
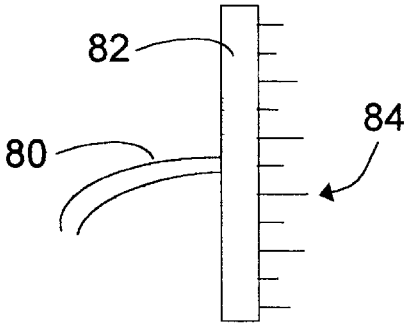
FIG. 14B is a side view of an injector support base and injecting needles that could produce a number of firm balls in a cushion similar to the one shown in FIGS. 10A and 10C.

FIG. 14B is a side view of an injector support base 82 and injecting needles 84 that could produce a number of firm balls in a cushion similar to the one shown in FIGS. 10A and 10C.

Figure 14C:
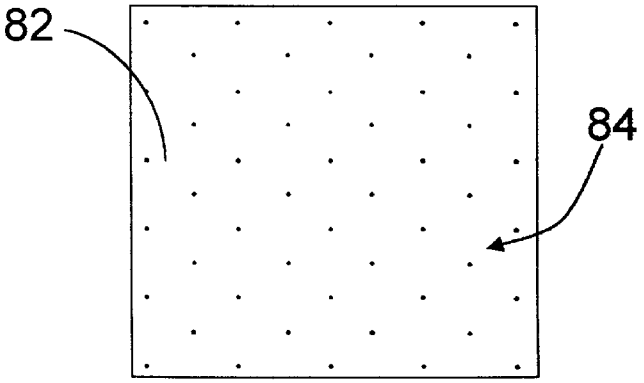
FIG. 14C is an underside view of an injector support base and injecting needles that are shown in FIGS. 14A and 14B.

FIG. 14C is an underside view of an injector support base 82 and injecting needles 84 that are shown in FIGS. 14A and 14B.

FIG. 15A is a front view of an injector support base 82 and injecting needles 84 that could be used to produce the insert shown on the cushion in FIG. 7B. Note that there is a line of firming solution marked 80S which carries a softer firming solution than the other firming solutions in the lines marked 80.

FIG. 15B is a side view of an injector support base and injecting needles that could produce a firm insert in a cushion similar to the one shown in FIGS. 7A–C using a large diameter needles 84D where the cushion will extend the furthest.

Figure 16A:
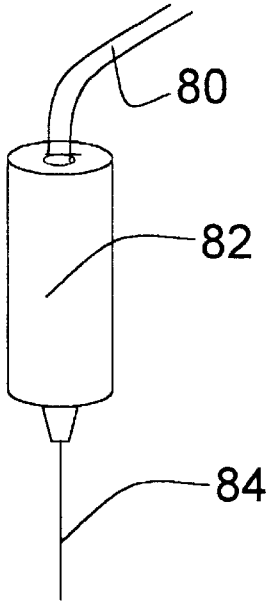
FIG. 16A is a front view of a single dispensing unit with one needle of the sort that might be used on a COMPUTER NUMERIC CONTROL (CNC) type system.

FIG. 16A is a front view of a single dispensing unit 82 with one needle 84 of the sort that might be used on a CNC type system.

Figure 16B:
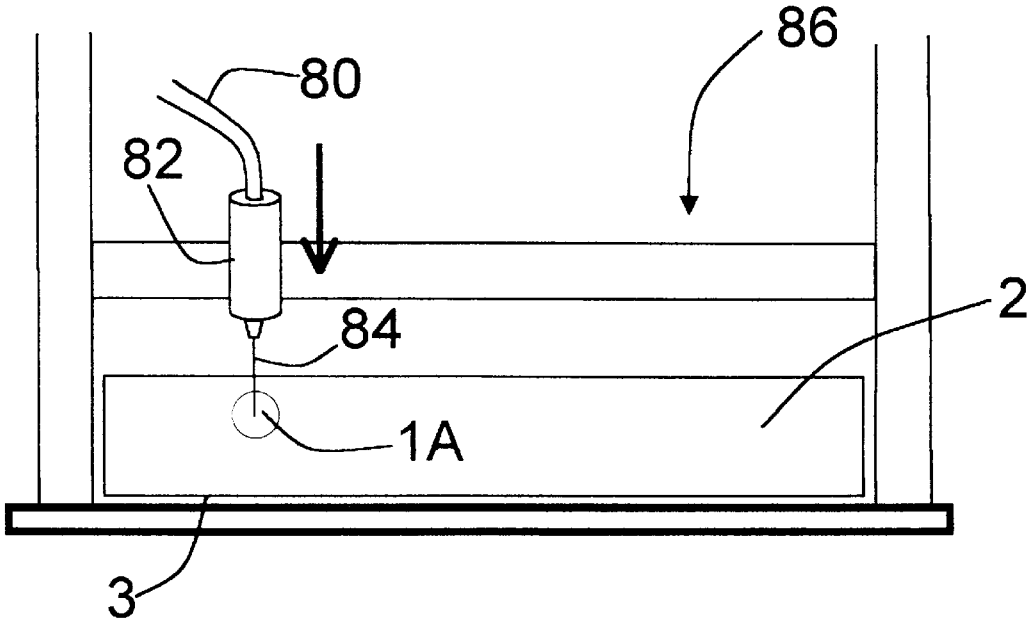
FIG. 16B is a front view of the single dispensing unit with one needle shown in FIG. 16A installed on a CNC type system.

FIG. 16B is a front view of the single dispensing unit 82 with one needle 84 shown in FIG. 16A installed on a CNC type system 86. Such a system would be capable of piercing cushions multiple times to various depths and in various locations, while dispensing varying amounts of firming solution. All of these variations could be controlled to provide high accuracy and speed in producing the types of cushions described above.

Figure 17A:
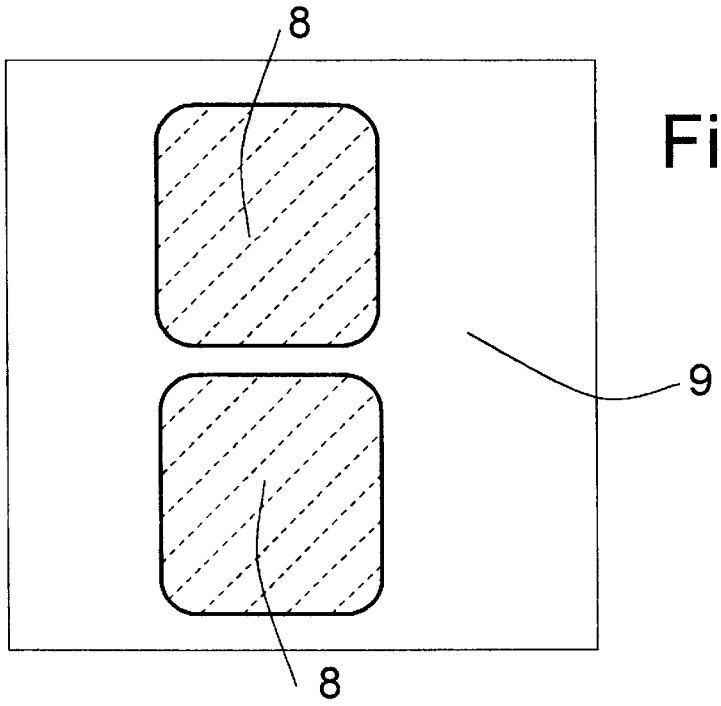
FIG. 17A is a top view of a cushion body with a softer support area that might be used on a seat cushion for providing greater comfort to the buttocks and thighs.

FIG. 17A is a top view of a cushion body 9 shown clear with softer support areas 8 that might be used on a seat cushion for providing greater comfort to the buttocks and thighs. The softer support areas 8 could be produced using a chemical known or to be known in the industry suitable for softening foam cushions.

Figure 17B:
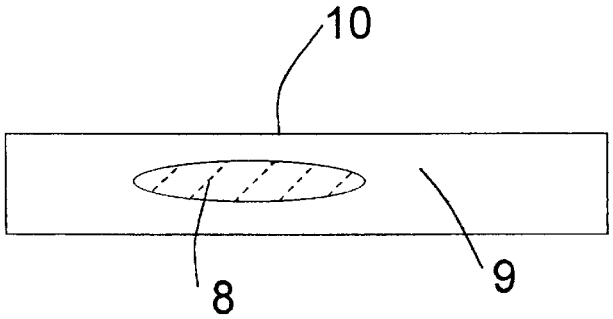
FIG. 17B is a side view of the cushion shown in FIG. 17A.

FIG. 17B is a cross section view of the cushion shown in FIG. 17A shown from the side. The face 10 is what the user of the cushion would sit on.

It should be noted that all cushions shown do not have firm area extending to the face, and therefore are thinner than the distance between the face and the back of the cushion. It should also be noted that the entire application must be read to understand some of the details briefly described with regards to various injecting base and needle configurations.

CONCLUSIONS, RAMIFICATIONS, AND SCOPE OF INVENTION

Although my above description contains many specificities, these should not be construed as limiting the scope of the invention, but merely as providing illustrations of the presently preferred embodiments of this invention. Many other variations are possible. This invention can be made a number of ways, with a wide variety of materials, it can be made with a number of accessories as part of it or to used be with it, and the principles of this invention can be applied to a number of other uses. It should be obvious that most embodiments described in this application can have features which are interchangeable among other embodiments shown.

For example, It is also possible that another high firmness cushion insert could be placed behind the shoulder area as well as the lumbar region to assist in orienting the upper body.

The support surface can be made somewhat concave from the left side to the right side to correspond with the shape of the chest/abdomen etc. of the human body.

I claim:

1. A method for making a firm internal support member in a previously manufactured resilient cushion body having a face and a back, the face being a body contacting surface and the back being the side of the cushion body opposite the body contacting surface, comprising the steps of:

(a) piercing the previously manufactured cushion body with injecting needles each having at least one dispensing hole; and (b) injecting a firming means, which is a foaming solution or a non-foaming solution, through said injecting needles into said cushion body, to soak into the cushion in a specific area, leaving that area firmer than the rest of the cushion body;

wherein the cushion body has a thickness defined as the distance between the face and the back, wherein the specific area that receives the firming means is thinner than the thickness of the cushion body, wherein the specific area does not extend to and is not in contact with the face of the cushion, wherein the specific area is defined by boundaries that form a definite shape suitable for providing extra support to specific parts of a human body when said human body is using the cushion body for comfort, and wherein the area of the cushion body which receives the firming means is determined by the quantities and properties of the firming means as well as the position of the needles and the openings in the needles through which the firming means is dispensed.

2. The method of claim 1 wherein the needles are secured to an injecting needle support base and positioned to extend from the injecting needle support base at different heights to define the shape or texture of the area in the cushion body that receives the firming means.

3. The method of claim 1 wherein the firming means comprises more than one chemical solution and wherein different chemical solutions are injected into the same cushion.

4. The method of claim 1 where the definite shape has at least one curved portion.

5. The method of claim 1 wherein the shape of the area which receives the firming means is in the shape of a generally semi-elliptical cylinder.

6. The method of claim 5 wherein the area which receives the firming means is suitable for use as a lumbar support.

7. A method for making at least one firm internal support member in a generally resilient cushion body having a face and a back, the face being a body contacting surface and the back being the side of the cushion opposite the body contacting surface, comprising the steps of:

(a) piercing the cushion body with at least one injecting needle, each respective injecting needle having at least one dispensing hole; and (b) injecting a firming means, which is a foaming solution or a non-foaming solution, through the injecting needle into said cushion body, to soak into the cushion in at least one specific area, causing the specific area to become firmer than before the firming means was introduced;

wherein the cushion body has a thickness defined as the distance between the face and the back, wherein the specific area that receives the firming means is thinner than the thickness of the cushion body, wherein the specific area does not extend to and is not in contact with the face of the cushion, wherein the specific area is defined by boundaries that form a definite shape which is suitable for providing extra support to specific parts of a human body when said human body is using the cushion body for comfort, and wherein the area of the cushion body which receives the firming means is determined by the quantities and the properties of the firming means as well as the position of the needle and the openings in the needle through which the firming means is dispensed.

8. The method of claim 7 wherein the specific area does not extend to and is not in contact with the back of the cushion.

9. The method of claim 7 wherein there are more than one of the injecting needles, and the injecting needles are secured to an injecting needle support base and positioned to extend from the injecting needle support base at different heights to define the shape or texture of the area in the cushion body that receives the firming means.

10. The method of claim 7 wherein there are more than one of the injecting needles, and the firming means comprises more than one chemical solution and wherein different chemical solutions are injected into the same cushion.

11. The method of claim 7 wherein there are more than one injecting needles, and wherein the diameter of at least one injecting needle is greater than the diameter of at least one other injecting needle.

12. The method of claim 7 wherein the injecting needles are controlled to dispense the firming means various points while the injection needle is moving during the process of piercing and withdrawing from the cushion body.

13. The method of claim 12 wherein the area which receives the firming means is suitable for use as a lumbar support.

14. The method of claim 7 wherein each injecting needle pierces and injects solution into the cushion at multiple times resulting in multiple specific areas receiving the firming means.

15. The method of claim 7 wherein the injecting needle set is on a COMPUTER NUMERIC CONTROL (CNC) type system to position and dispense the firming means in various numbers of times, in various positions, and in various quantities.

16. The method of claim 7 wherein each cushion is injected to produce multiple specific areas, wherein each area is generally ball shaped, and wherein at least one generally ball shaped is not in contact with other specific areas that receive the firming means.

17. A method for changing the firmness of at least one area in a generally resilient cushion body having a face and a back, the face being a body contacting surface and the back being the side of the cushion body opposite the body contacting surface, comprising the steps of:

(a) piercing the cushion body with at least one injecting needle having at least one dispensing hole; and (b) injecting a firmness altering means, which is a foaming solution or a non-foaming solution, through the injecting needle into said cushion body, to soak into the cushion in a specific area, causing the specific area to become a different firmness than before the firmness altering means was introduced;

wherein the cushion body has a thickness defined as the distance between the face and the back, wherein the specific area that receives the firmness altering means is thinner than the thickness of the cushion body, wherein the specific area does not extend to and is not in contact with the face of the cushion, wherein the specific area is defined by boundaries that form a definite shape which is suitable for providing a particular level of support to specific parts of a human body when said human body is using the cushion body for comfort, and wherein the area of the cushion body which receives the firmness altering means is determined by the quantities and properties of the firmness altering means as well as the position of the needle and the openings in the needle through which the firmness altering means is dispensed.

18. The Method of claim 17 wherein the firmness altering means comprises a chemical means that softens the specific area.

19. The method of claim 17 wherein the specific area does not extend to and is not in contact with the back of the cushion.

20. The method of claim 17 wherein there are at least two of the injecting needles, and the firmness altering means comprises more than one chemical solution and wherein different chemical solutions are injected into the same cushion.

21. The method of claim 17 wherein the area which receives the firming means is on a seat cushion and is suitable for better distributing the weight of a user's thighs and buttocks.

* * * * *